US006382100B1

(12) United States Patent
Satoh et al.

(10) Patent No.: US 6,382,100 B1
(45) Date of Patent: May 7, 2002

(54) WEB GUIDE ROLLER, AND PRINTING PRESS INCORPORATING THE SAME

(75) Inventors: Masayoshi Satoh; Yosuke Nobuta, both of Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/641,886

(22) Filed: Aug. 18, 2000

(30) Foreign Application Priority Data

Dec. 28, 1999 (JP) ..... 11-372742

(51) Int. Cl.[7] ..... B41F 13/00

(52) U.S. Cl. ..... 101/212; 101/420; 425/75; 34/638; 34/573; 271/195; 226/196.1; 242/615

(58) Field of Search ..... 101/212, 420; 400/578; 425/75; 34/573, 638; 242/615; 226/196.1; 271/6, 195

(56) References Cited

U.S. PATENT DOCUMENTS

| | | | | | |
|---|---|---|---|---|---|
| 3,567,093 | A | * | 3/1971 | Johnson | 242/615 |
| 3,750,305 | A | * | 8/1973 | Loser | 34/573 |
| 4,059,241 | A | * | 11/1977 | De Roeck | 226/196.1 |
| 4,236,814 | A | * | 12/1980 | Towkla | 271/6 |
| 4,493,548 | A | * | 1/1985 | Ateya | 271/195 |
| 4,776,107 | A | * | 10/1988 | Buske | 34/638 |
| 4,792,249 | A | * | 12/1988 | Lahr | 400/578 |
| 5,223,903 | A | * | 6/1993 | Russel et al. | 400/624 |
| 5,536,158 | A | * | 7/1996 | Dresie et al. | 425/75 |
| 6,125,754 | A | * | 10/2000 | Harris | 101/420 |

FOREIGN PATENT DOCUMENTS

| | | |
|---|---|---|
| JP | 5-28632 | 4/1993 |
| JP | 7-53102 | 2/1995 |
| JP | 10-202839 | 8/1998 |
| JP | 11-207928 | 8/1999 |

* cited by examiner

*Primary Examiner*—Eugene Eickholt
(74) *Attorney, Agent, or Firm*—Rader, Fishman & Grauer, PLLC

(57) ABSTRACT

A roller assembly positioned downstream of a printing station in a web-fed rotary printing press for pneumatically guiding a web of paper after it has been printed upon, without the risk of smearing the printings. The assembly includes a roller in the form of a hollow cylinder defining a plenum chamber therein and having formed in its surface a multiplicity of air outlet openings in communication with the plenum chamber. Air supplied under pressure to the chamber is therefore expelled from the air outlet openings in order to avoid contact with the roller the web traveling over the rollera baffle encloses at least part of the circumferential part of the roller surface for confining the air being expelled from said at least part of the other circumferential part of the roller surface and for redirecting the confined air into a pair of spaces, spaced, between the web and the roller.

14 Claims, 8 Drawing Sheets

WEB GUIDE ROLLER, AND PRINTING PRESS INCORPORATING THE SAME

BACKGROUND OF THE INVENTION

This invention relates to a roller construction for noncontact guiding of an elongate strip of pliant material, and particularly to such a roller construction capable of pneumatically guiding a web of paper in a rotary printing press without contacting, and so without smearing, the printed surface or surfaces of the web. The noncontact roller according to the invention finds a typical application in a web-fed, multicolor, offset printing press for both pneumatically guiding the web and thermally drying the printed images thereon as the web emerges from a stack of printing units.

A variety of roller constructions have been suggested, and some actually built into rotary printing presses, for drying the images immediately after having been printed on the web or for guiding the printed web without smearing the printings. Japanese Unexamined Patent Publication No. 10-202839 suggests the installation, in a web-fed printing press, of a heating roller and a cooling roller downstream, with respect to the traveling direction of the web, of a printing station in lieu of a more conventional web drying device that consumed large amounts of heated air. The web travels in contact with at least one quarter of the circumference of each such roller. The heating roller has mounted therein a coil, which is to be heated with an alternating current, and is driven at a peripheral speed different from the traveling speed of the web.

An objection to this prior art apparatus is that the traveling web contacts the heating roller and, moreover, rubs against the same as a direct result of the speed difference therebetween. Thus the printing on the web have often not only soiled the web surface but also, the printing ink being so adhesive, adhered to the heating roller. As an additional disadvantage, the drying of the printing by both the heating and cooling has necessitated complex and bulky equipment and also required constant monitoring for temperature control.

Japanese Unexamined Patent Publication No. 11-207928 teaches a noncontact web guide system comprising, in the order of the traveling direction of the web, a hot-air dryer right above a printing station, a noncontact guide roller for horizontally redirecting the web, another noncontact guide roller for further redirecting the web vertically downwardly, and a cooling roller therebelow. All the noncontact guide rollers of this second prior art device are in the form of hollow cylinders of porous material. The rollers are so permeable to air that, fed under pressure into the hollows in the rollers, the air flows through the porous bodies of the rollers and is expelled from all over their surfaces thereby keeping the traveling web out of contact therewith. These rollers are driven at a peripheral speed of not more than half the running speed of the web.

The hot-air dryer and the cooling roller together with the interposed noncontact guide rollers according to this second unexamined patent make up a web guide system of what seems to the instant applicant unnecessarily large space requirement. It is also unjustifiably high in both manufacturing and running costs.

The noncontact guide rollers of porous material are themselves objectionable because of too much waste of pressurized air from those surface portions of the rollers which are left exposed by the web. The curtailment of this waste has been limited, moreover, by the fact that the air pressure has nevertheless had to be sufficiently high to hold the traveling web away from the roller surface. Still further, as the rollers have to be driven at about half the traveling speed of the web, drive linkages have had to be installed at additional costs for rotating the rollers at the required speed.

Japanese Unexamined Patent Publication No. 7-53102 proposes a slightly different noncontact roller, this one being in the form of a hollow cylinder of sintered metal. The roller has a multiplicity of radial pores which are as small in diameter as from ten to thirty micrometers. The web is kept out of contact with the roller surface by the layer of the pressurized air coming out from the pores. The web can be dried by heating the air that is fed under pressure into the roller.

This third prior art device is questionable, however, as to the air that is forced out through that surface portion of the sintered metal roller which is left unembraced by the web. The unexamined patent's specification merely says on this subject that, preferably, the air should be caused to emit from only that part of the roller surface which is covered by the web, and should be shut off from the rest of the roller surface. No means are disclosed to that end.

Additionally, the sintered metal rollers possess their own drawbacks. They have their metal particles not sufficiently firmly bonded together to withstand use under the most rigorous printing conditions as, for example, in a newspaper printing machine where the roller is required to guide a very wide web running at high speed.

A further weakness of the sintered metal rollers is the filter-like fineness of their pores, which in consequence have been very easy to clog up from within the roller. This weakness has been remedied only by combined use of a large filter system for supplying clean air into the rollers, making the complete guide system even bulkier and more expensive.

The sintered metal rollers have the further yet drawback that, as an inherent result of their method of fabrication, the pores are not uniformly distributed all over the roller surfaces. Thus, with the irregular emission of air from the roller surfaces, the web has been easy to flutter and even contact them, causing the softened ink to stick to the rollers. The sticking ink has indeed been another cause of pore clogging. For all these reasons the sintered metal rollers have necessitated frequent cleaning and replacement and so added significantly to the maintenance costs of the printing press.

Japanese Unexamined Utility Model Publication No. 5-28632 is directed to a nonrotating turnbar for causing a directional change of a web. Tubular in shape, the turnbar has air exit openings formed in its surface portion that is to face the web, for pneumatically holding the web away as in all the references cited above. The unexamined utility model features an air duct disposed on the side of the turnbar opposite to its side facing the web, for supply of additional pressurized air into the space between web and turnbar through nozzles joined to the duct on both upstream and downstream sides of the space.

The teachings of this unexamined utility model are not applicable to guide rollers, however. As an additional disadvantage, two separate passageways are required for supplying pressurized air into the space between web and turnbar, one through the interior, and the other through the exterior, of the turnbar. The resulting air supply system is inordinately bulky and complex.

SUMMARY OF THE INVENTION

In view of the foregoing state of the art the present invention has it as an object to provide a noncontact web guide roller assembly of simpler and less expensive construction than the prior art, capable of pneumatically guiding a printed web without smearing the printings or allowing the ink to attach to the roller or other parts and so reducing the waste of paper to a minimum.

Another object of the invention is to provide a noncontact web guide roller assembly of the kind defined, which is adaptable for use with both hot and cold air, for thermally drying and cooling the printed web.

A further object of the invention is to make most effective, wasteless use of the air emitted from the roller for heating, cooling, or simply guiding the web and hence to minimize the operating costs of the roller assembly.

A further object of the invention is to stabilize the posture of the web flying over the roller.

A still further object of the invention is to preclude the clogging of the air exit openings of the roller.

A yet further object of the invention is to make the roller very sturdy in construction and capable of well withstanding use in today's high-speed newspaper printing press.

Stated broadly in one aspect thereof, the invention concerns a noncontact guide roller assembly comprising a roller in the form of a hollow cylinder defining a plenum chamber therein. The roller has formed in its surface a multiplicity of air outlet openings in communication with the plenum chamber, so that air supplied under pressure to the plenum chamber is expelled from the air outlet openings in order to keep out of contact with the roller a web traveling over circumferential part of the roller surface. The roller assembly also includes baffle means enclosing at least part of the other circumferential part of the roller surface for confining the air being expelled from the openings in the at least part of the other circumferential part of the roller surface and for redirecting the confined air into a pair of spaces, spaced circumferentially of the roller, between the web and the roller.

In use of the roller assembly of the foregoing construction in a web-fed rotary printing press, in a position downstream of a printing station, hot or cold air is to be forced into the plenum chamber within the roller. The air will be expelled under pressure from all over the roller surface, causing the web to fly over certain circumferential part of the roller surface. The roller itself is of very simple mechanical construction and can be made just as sturdy as any other rollers or cylinders currently in use in high-speed newspaper printing presses. The openings in its surface, moreover, need not be so fine as in some prior art devices, requiring no air filtration.

The baffle means, for recovery and reuse of the air escaping from the other circumferential part of the roller surface, is no less simple and strong in construction than the roller, besides being very compact. It is simply a baffle or enclosure, preferably approximately semitubular in shape, defining an air recovery chamber for confining the escaping air. This chamber is open, via openings in a pair of side walls of the baffle which are spaced from each other circumferentially of the roller, to the noted pair of spaces between the web and the roller. The recovered air is therefore redirected into these spaces in order to assure stable web flight over the roller. Thus the air delivered under pressure into the plenum chamber is totally wastelessly utilized for the intended purposes.

Preferably, valve means should be provided for adjustably varying the flow rates of the air through the openings in the baffle side flanges. The valve means adopted in the preferred embodiment are manually operable for independent adjustment of the air pressures in the upstream and downstream side spaces between web and roller in relation to the air pressure supplied directly to the web from the roller surface. Such independent pressure adjustment has proved to lead to unfluttering, nonundulating web flight over the roller.

A further feature of the invention is that the air outlet openings in the roller are inclined upstream, with respect to the prescribed traveling direction of the web, as they extend radially outwardly of the roller. The traveling web will then encounter greater resistance from the airstreams being expelled, and so more easily fly over the roller.

Another aspect of the invention concerns a rotary printing press incorporating one or more noncontact guide roller assemblies of the foregoing construction for drying or simply guiding the web. In a preferred embodiment, in which the invention is applied to a streamlined newspaper printing, cutting, and folding machine, two such roller assemblies are provided in succession, both downstream of the printing station. The upstream roller assembly emits hot air, and the downstream one cold air, for most efficiently drying the printings on the web. The two roller assemblies can be of identical make, the only difference being the temperature of the air supplied thereto.

The above and other objects, features and advantages of this invention and the manner of achieving them will become more apparent, and the invention itself will best be understood, from a study of the following description and attached claims, with reference to the accompanying drawings showing the preferred embodiments of the invention.

DESCRIPTION OF THE PREFERRED EMBODIMENTS

Figure 1:
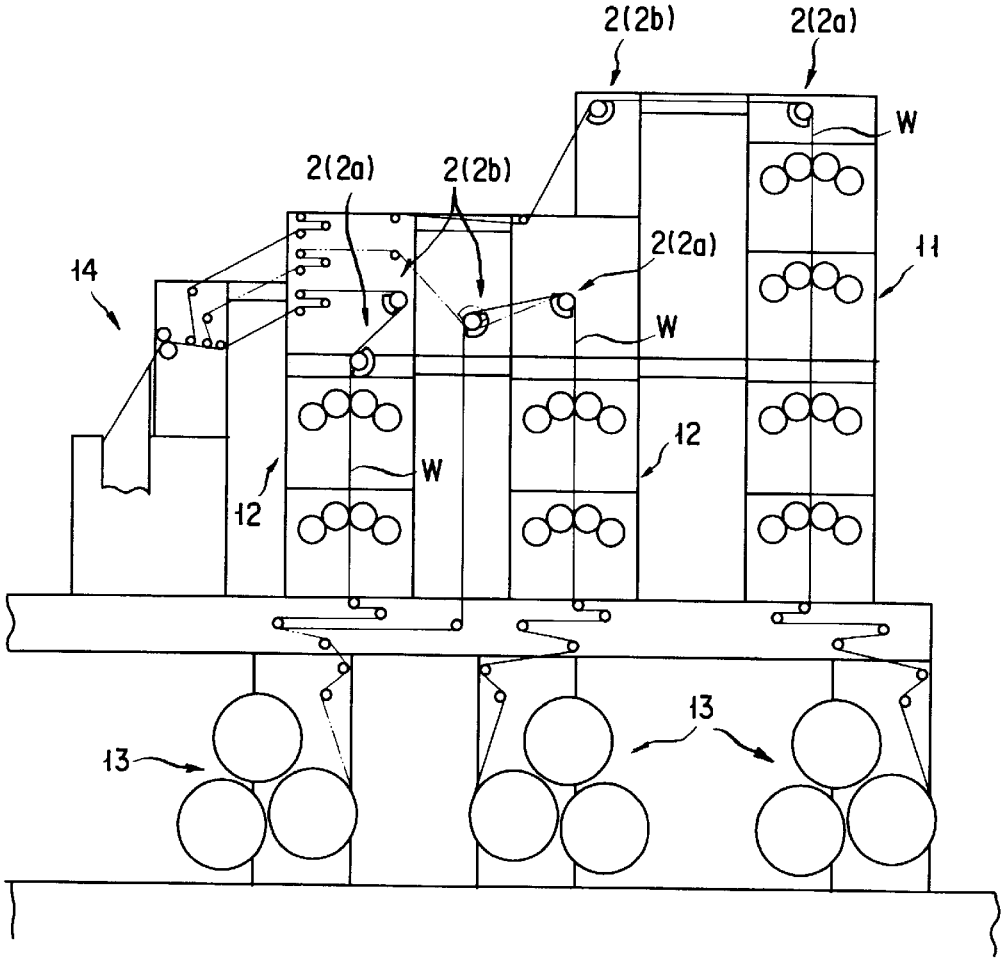
FIG. 1 is a schematic illustration of a web-fed, rotary offset printing machine capable of newspaper production, the machine incorporating noncontact roller assemblies according to the instant invention for both guiding and drying the printed webs.

The present invention is currently believed to be best applicable to the noncontact guiding, and drying, of a continuous web of paper, after its has been printed upon, in an offset printing press of the kind suitable for newspaper production. FIG. 1 shows such a machine incorporating several noncontact web guide roller assemblies according to the invention. The exemplified machine is a multiple-color, roll-to-folder, offset perfecting press capable of concurrently printing on three webs W being paid out from their rolls, each on both surfaces thereof, then placing the printed webs one on top of another, then cutting and folding them for delivery in the form of multiple-page signatures.

Broadly, the illustrated machine comprises: (a) a first printing station 11 having a stack of four offset perfecting printing units for printing four colors on both sides of a web W; (b) a second and a third printing station 12 each having a stack of two offset perfecting printing units for printing two colors on both sides of an additional web W; (c) three web supply stations 13 holding web stocks in roll form for supply to the respective printing stations 11 and 12; and (d) a postprinting processing station 14 shown as a folding station for cutting and folding the printed webs altogether.

The printing press construction set forth in the preceding paragraph is conventional, and therein lies no feature of the instant invention. The instant invention is specifically directed to the roller assemblies 2 shown mounted between the printing stations 11 and 12 and the folding station 14 for the dual objective of guiding and drying the printed webs W. All the roller assemblies 2 are of like mechanical construction. Functionally, however, they are divisible into heating roller assemblies 2*a* and cooling roller assemblies 2*b*. The heating roller assemblies 2*a* lie upstream of the cooling roller assemblies 2*b* with respect to the traveling direction of the webs W.

It is to be understood, however, that the showing, in FIG. 1, of one heating roller assembly 2*a* and one cooling roller assembly 2*b* on each web path from printing station to postprinting processing station is by way of example only. In the practice of the invention in its simplest form, either one heating, or one cooling, roller assembly may be employed as required for noncontact drying of one web or for causing a noncontact directional change thereof with or without concurrent drying of the web.

Both roller assemblies 2*a* and 2*b* are constructed to pneumatically hold the traveling webs W away from the roller surfaces as they travel past them. The heating roller assemblies 2*a* are further intended to be supplied with, and so themselves to emit, heated air to serve the additional purpose of accelerating the desiccation, both by infiltration into the web interstices and by evaporation, of the ink images that have been offset printed on the webs W at the printing stations 11 and 12.

Generally, the offset printing ink used for newspaper production is composed of pigments, resins, and a solvent. The solvent in particular is usually of such a high boiling point, and is contained at such a high percentage, that, unlike gravure printing ink for instance, the newspaper ink does not readily dry by evaporation at room temperature. Instead, the newspaper ink printings on the web fix as the solvent and other low-viscosity components of the ink gradually infiltrate the paper, leaving the pigments and other high viscosity ink ingredients on its surface. An inconveniently long period of time would be required for the newspaper ink printings to dry at room temperature.

For quickly drying such printings the heating roller assemblies 2*a* according to the invention are constructed most efficiently to apply heated air to the webs W traveling past them just after they have emerged from the printing stations 11 and 12. The heated air is intended to heat both webs and printings, thereby accelerating the infiltration into the webs of the ink ingredients such as resins and solvent through reduction of their viscosities and also hastening the evaporation of the solvent that would not readily evaporate at room temperature.

So heated by the heating roller assemblies 2*a*, the printed webs W will come to the cooling roller assemblies 2*b* with the printings thereon, though partly dried with the progress of infiltration and evaporation, not completely cooled yet but still softened. The cooling roller assemblies 2*b* will apply cold or unheated air, preferably not more than approximately 30° C. in temperature, to the webs W, thereby both holding them away from the roller surfaces and cooling the ink thereon. The resins and high-viscosity solvent, which is particularly slow in evaporation, of the ink will then solidify, resulting in the fixation of the images on the webs.

The webs W will contact none of these roller assemblies 2*a* and 2*b* as they travel, being guided and dried thereby. Neither webs nor roller assemblies will therefore be stained by the ink.

The roller assemblies 2*a* and 2*b* may be used in any convenient locations downstream of the printing stations 11 and 12, provided that the resulting paths of travel of the webs are such that they enwrap the rollers through an angle θ ranging from 30 to 210 degrees. It is therefore understood that the arrangement of these roller assemblies indicated in FIG. 1 is for illustrative purposes only and to impose no limitations whatsoever upon the invention. For instance, in the showing of FIG. 1, the printed webs that had been heated by the heating roller assemblies 2*a* might cool down by the time they arrived at the cooling roller assemblies 2*b* if there were sufficiently long distances between the heating and the cooling roller assemblies. In such cases the cooling roller assemblies might be omitted, and only one heating roller assembly would be adopted to dry each printed web without the risk of the printings thereon smeared by, or smearing, the contact guide rollers or other web-handling means downstream of the noncontact heating roller assembly. Only one noncontact heating roller assembly downstream of a printing station will suffice, too, in machines using gravure printing ink or the like that are easy to evaporate at room temperature.

Whether one or more noncontact roller assemblies according to the invention are used for drying each printed web, the air emitted by such a roller assembly or assemblies may not necessarily be heated or cooled, either. Air at room temperature may be used instead for the purpose of noncontact, smearless guiding of the web.

Still further, whatever the arrangement and the air temperature may be, the rollers of the noncontact roller assemblies according to the invention should preferably be of a material that resists easy adhesion of the ink. This is to minimize the soiling of the rollers when the webs come to a standstill and rest thereon or when the machine otherwise goes out of operation.

Both heating and cooling roller assemblies 2*a* and 2*b* are alike in construction as aforesaid, the only difference therebetween being the temperature of the pressurized air that is supplied thereto and emitted therefrom. Only one such roller assembly, designated 2, will therefore be described in detail with reference to FIGS. 2, 3 and 4, with the understanding that such description applies to both types of roller assemblies 2*a* and 2*b*.

Figure 2:
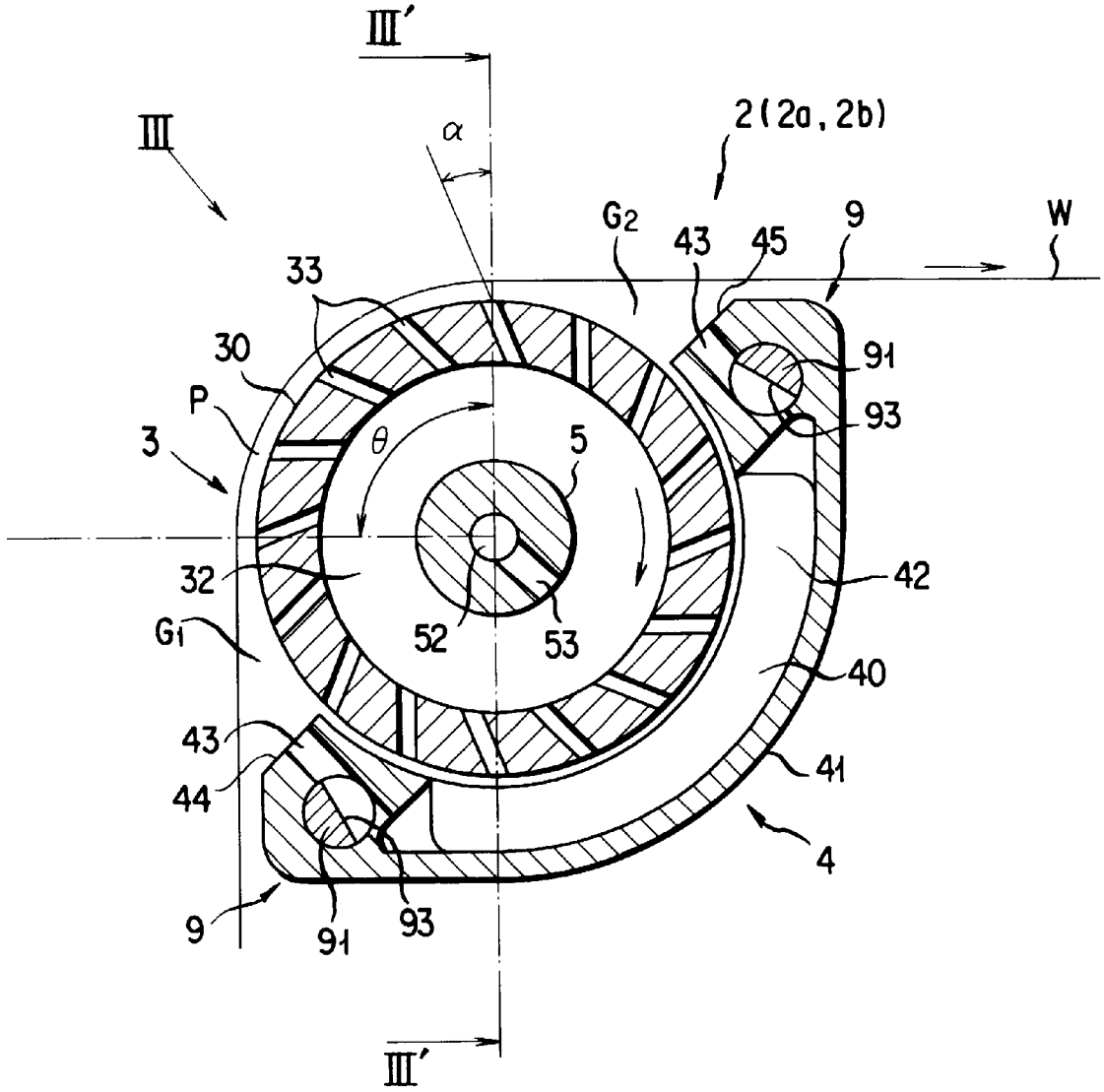
FIG. 2 is an enlarged, transverse section through one of the roller assemblies of the FIG. 1 machine.

As best drawn in FIG. 2, the representative roller assembly 2 broadly is a combination of a hollow, perforated roller 3 and baffle means 4. As the web W is shown to embrace the roller 3 through an angle θ of approximately 90 degrees, the roller 3 emits air from all over its perforated surface for holding the traveling web W away therefrom. The baffle means 4 recovers the air that is escaping from that circumferential part of the roller surface which does not confront the web, and redirects the recovered air into both upstream and downstream spaces between the web and the roller With reference to both FIGS. 2 and 3 the roller 3 of the roller assembly 2 takes the form of a hollow cylinder. Extending coaxially through the roller 3 is a nonrotatable shaft 5 which has its opposite ends anchored to a pair of confronting frame walls F and fastened thereto as by countersunk screws 51. The shaft 5 has a diameter so much less than the inside diameter of the roller 3 that a plenum chamber 32 of tubular shape is defined therebetween. The roller 3 is rotatably supported on the shaft 5 via a pair of antifriction bearings, one seen at 6 in FIG. 3, which are disposed at or adjacently to both ends of the roller. A pair of sealing rings, also one seen at 61 in FIG. 3, are installed inwardly of the bearings 6 for sealing the plenum chamber 32 without substantially interfering with the rotation of the roller 3 relative to the shaft 5.

An air passageway 52 extends axially through the shaft 5 from one end thereof, terminates approximately centrally of the shaft, and communicates with the plenum chamber 32 via an exit port 53 extending radially of the shaft. An air entrance port 54 is formed in one end portion of the shaft 5 which is left exposed by the roller 3. The entrance port 54 communicates with a source of pressurized air, not shown, by way of a conduit 56. Thus air is supplied under pressure from the unshown source to the plenum chamber 32 via the axial passageway 52 in the shaft 5.

Figure 3:
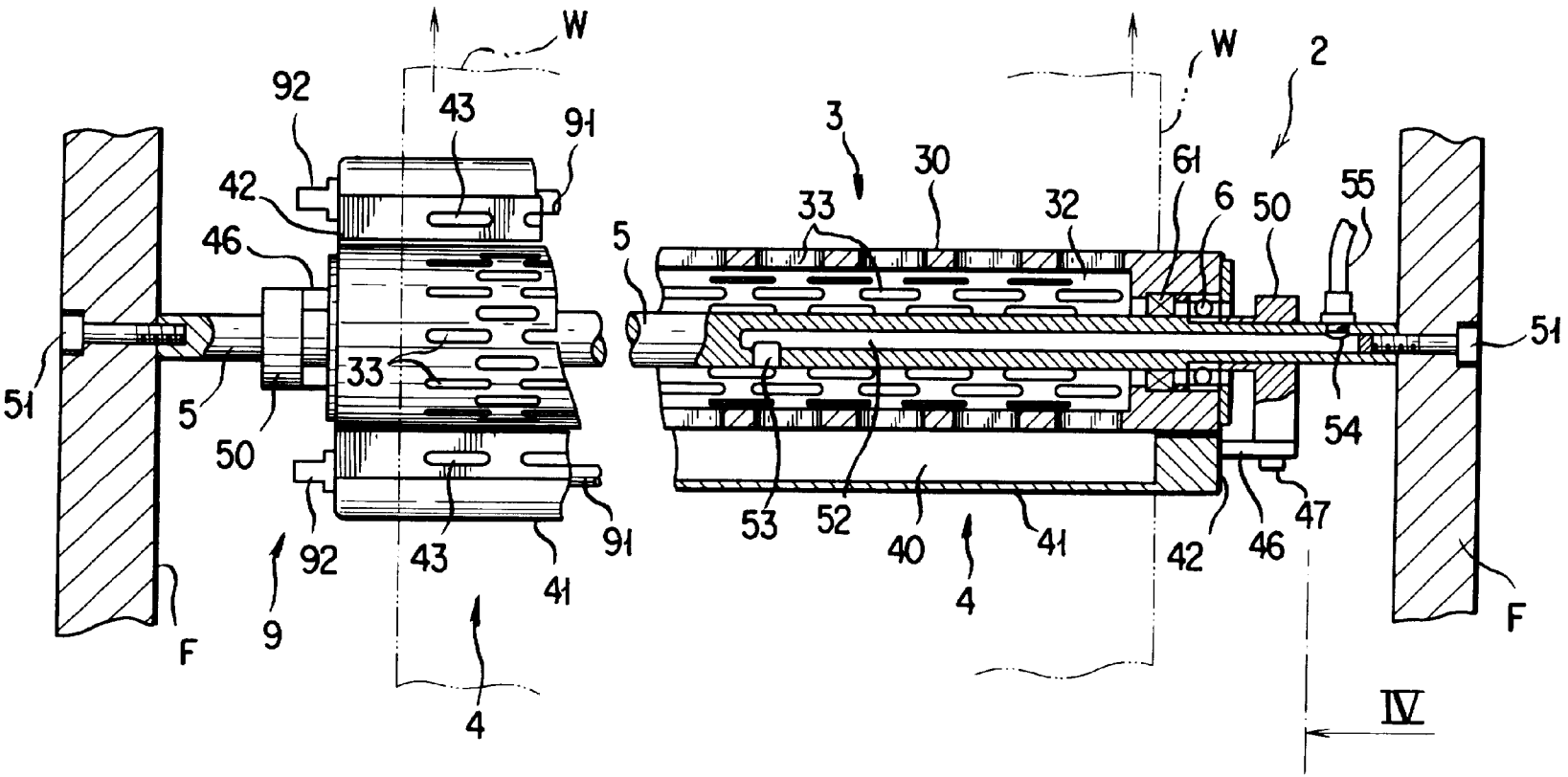
FIG. 3 is a partly elevational, partly sectional view of the FIG. 2 roller assembly shown together with the web flying thereover, the elevational view being as seen in the direction of the arrow III in FIG. 2, and the section being taken along the line III'—III' in FIG. 2.

Both FIGS. 2 and 3 show a multiplicity of air outlet openings 33 formed in the roller 3 all over its surface. All the air outlet openings 33 are in direct communication with the plenum chamber 32, so that air is expelled under pressure from all these openings against the web W traveling around the roller 3, causing the web to fly over the roller as pictured in FIG. 2.

With continued reference to FIG. 2, the air outlet openings 33 extend approximately radially of the roller 3 or, preferably, at an angle to the radial direction of the roller 3. Let us assume that the web W travels in the direction of the arrow in FIG. 2. The roller 3 is to rotate in the same direction, indicated by another arrow, as the web W. The direction is clockwise as viewed in this figure. Each air outlet opening 33 should preferably be inclined upstream, with respect both to the traveling direction of the web W and to the rotational direction of the roller 3, as it extends radially outwardly of the roller. This angular orientation of the openings 33 is more conducive to stable web flight over the roller, as will be later discussed in more detail. In practice, the angle $\alpha$ of inclination of each air outlet opening 33 relative to the radial direction of the roller 3 may be anywhere from zero to about 60 degrees.

The air outlet openings 33 are each shown to be slotlike in shape in FIG. 3, elongated longitudinally of the roller 3. Further such slotlike openings are aligned longitudinally of the roller 3, and the longitudinal rows of openings are alternately staggered. However, the illustrated shape, size, number, and arrangement of the air outlet openings 33 are merely illustrative and not limitative of the invention. They may be variously modified in each specific application of the invention, depending for example upon the width, weight, and pliancy of the web and on the diameter of the roller 3.

Preferably, however, the arrangement of the air outlet openings 33 in the axial direction of the roller 3 should not exceed the width of the web to be handled. The openings 33 should also be uniformly distributed axially of the roller 3. In some cases, there may be too much air escaping from the opposite sides of the web, with the result that the edge portions of the web do not fly high enough above the roller surface. Then either the air outlet openings may be more densely distributed in portions adjacent to the opposite ends of the roller 3 than in its midportion, or the openings may be made larger in size in portions adjacent to the opposite ends of the roller than in its midportion.

The baffle means 4, the other component of the representative roller assembly 2, will now be detailed with reference to FIGS. 2, 3 and 4. The baffle means 4 includes a baffle 41 of approximately semitubular shape which is held opposite that side of the roller 3 which faces away from the web W, and which extends throughout the length of the roller. As seen cross-sectionally in FIG. 2, the baffle 41 is approximately concentric with the roller 3 and is spaced therefrom to define an air recovery chamber 40 of arcuate cross section therebetween. The air outlets 33 of the roller 3 are open directly to this air recovery chamber 40 as they come opposite the baffle 41.

The baffle 41 is formed in one piece with a pair of end walls 42, FIG. 3, and a pair of side walls 44 and 45, FIG. 2. The end walls 42 close the opposite ends of the air recovery chamber 40 in the axial direction of the roller 3. The side walls 44 and 45 close the opposite sides of the air recovery chamber 40 in the circumferential direction of the roller 3. FIG. 2 clearly indicates that both end walls 42 and side walls 44 and 45 have edges held close to the surface of the roller 3 but nevertheless spaced therefrom to avoid sliding engagement therewith.

Figure 4:
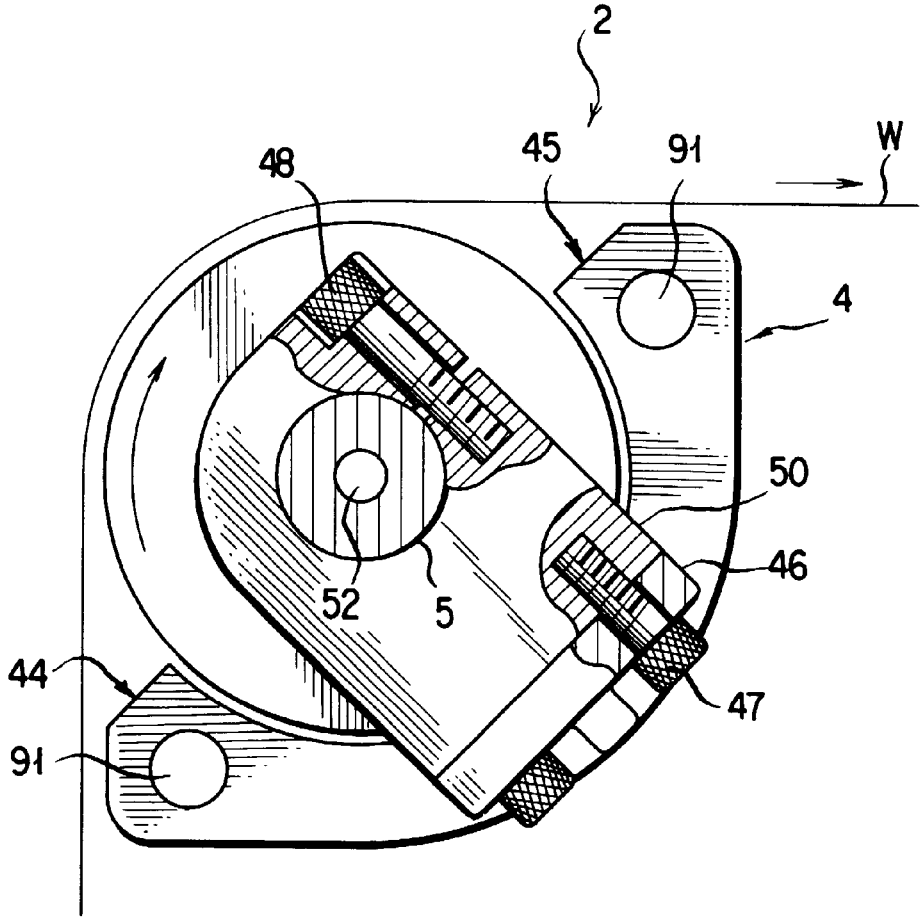
FIG. 4 is an end elevational view of the FIGS. 2 and 3 roller assembly, seen in the direction of the arrow IV in FIG. 3, the roller assembly being shown partly sectioned to reveal other parts.

As will be understood from FIG. 4 taken together with FIG. 3, in order to support the baffle means 4 in the desired positional relationship to the roller 3, a pair of mounting lugs 46 extend from the end walls 42 of the baffle 41 in parallel spaced relationship to the shaft 5. The lugs 46 are secured by screws 47 to a pair of mounting arms 50 on the shaft 5. The mounting arms 50 clamp themselves around the shaft 5 by screws 48. By loosening these screws, then, the mounting arms 50 are angularly displaceable around the shaft 5. The complete baffle means 4 is therefore angularly adjustable on the shaft 5 in order to be installed in the optimal angular position relative to the roller 3 according to the path of the web W thereover.

A reconsideration of FIG. 2 will indicate that a pair of spaces $G_1$ and $G_2$ of approximately triangular cross sectional shape are bound by the web W, the roller 3 and the side walls 44 and 45 of the baffle 41, in positions just upstream and downstream of the plenum space P of approximately constant thickness holding the web away from the roller. These spaces $G_1$ and $G_2$ will be hereinafter referred to as web-roller gaps.

As shown in both FIG.2 and 3, the pair of baffle side walls 44 and 45 have each a series of air outlet openings 43 of slotlike or elliptic cross sectional shape formed therethrough whereby the air recovery chamber 40 defined by the baffle 41 is placed in communication with both upstream and downstream web-roller gaps G1 and $G_2$. The air that has been confined in the baffle 41 is thus redirected and introduced into the web-roller gaps $G_1$ and G2 through these openings 43 in the baffle side walls 44 and 45.

As an ancillary feature of the invention, the flow rates of the air being so redirected into the web-roller gaps $G_1$ and $G_2$ are made adjustable in order to assure optimal web flight, unfluttering and contact-free, over the roller 3. To this end each series of air outlet openings 43 on the baffle side flange 44 or 45 is provided with a valve 9, FIGS. 2 and 3, for joint flow-rate control of the air therethrough. Each flow control valve 9 includes a stem 91 rotatably extending longitudinally through the baffle side flange 44 or 45. Circular in cross-sectional shape, each valve stem 91 has a series of recesses 93 of semicircular shape formed at longitudinal spacings therein in register with the respective openings 43. The valve stem 91 has one end projecting outwardly of the baffle side flange 44 or 45 and terminates in a knob 92.

The two knobs 92 on the baffle side walls 44 and 45 are to be manually turned bidirectionally in order to vary the angular positions of the valve stem recesses 93 with respect to the series of air outlet openings 43 in the baffle side walls 44 and 45. The flow rates of the air emitted from both baffle side walls 44 and 45 are thus independently adjustable.

The shape, size, and arrangement of the recesses 93 in each valve stem 91 depend upon the shape, size, and arrangement of the air outlet openings 43 in each baffle side flange 44 or 45. If the openings 43 are of slotlike cross section as depicted in FIG. 3, for example, then the recesses 93 should be provided one for each such opening, each with a matching dimension in the longitudinal direction of the stem. Each recess 93 should also be cut to such a depth in the diametric direction of the stem 91 that the air flow rate through the openings 43 are adjustable anywhere between fully closed and fully open positions. The openings 43 may also take the form of relatively small holes. In that case the valve stems 91 may be so recessed that each recess encompasses a suitable number of such small holes. In either case those parts of each valve stem 91 where the recesses are not formed make a sliding fit with the baffle side flange 44 or 45 to permit rotation of the valve stem by the knob 92.

It is thus seen that the flow rates of the air being introduced into the web-roller gaps $G_1$ and $G_2$ from the two series of openings 43 in the baffle side walls 44 and 45 are independently adjustable by the turn of the knobs 92. It will also be understood that, as the flow rates of the air emitted through the openings 43 are adjustably varied as above, so, indirectly, is the flow rate of the air expelled from the openings 33 in the surface of the roller 3 for direct application to the web W.

The independent adjustment of the flow rates of the air through the baffle side flange openings 43 is tantamount to the independent adjustment of the air pressures acting on the upstream and downstream sides of the web flying over the roller 3, in relation to the pressure of the air being applied directly from the roller openings 33 to the midpart of the flying web. Consequently, by employing an adjustable source of air pressure, not shown, the air pressures on the upstream side, midpart, and downstream side of the web around the roller 3 are variable relative to one another in any desired manner, as will be discussed in more concrete terms hereafter.

Looking at the way the web W flies over the noncontact roller assembly 2, the press supervisor may desire to make the air pressure of the web midpart space P higher without an accompanying increase in the air pressures of the upstream and downstream side web-roller gaps $G_1$ and $G_2$. Then he may increase the rate of supply of the pressurized air from the unshown source and, by manipulating the knobs 92, lower the web upstream and downstream side gap air pressures to the same level as before.

He may also desire to boost the web upstream and downstream side gap air pressures but to keep up the web midpart space air pressure. He may then also increase the air supply rate from the unshown source and, again by manipulating the knobs 92, increase the orifices in the baffle side flange openings 43. Of course, in both cases, only one of the knobs 92 may be manipulated to independently modify either the web upstream or downstream side gap air pressure in relation to the other and to the web midpart space air pressure.

In operation, all the heating roller assemblies 2*a* may be in placed in communication with a source of heated air under pressure, not shown, and all the cooling roller assemblies 2*b* with a source of cooled air under pressure, also not shown, via suitable piping and valving. Air may of course be pressurized, then heated or cooled, by different means. The heated or cooled air under pressure will enter the plenum chambers 32 within the rollers 3 through the passageway 52, FIG. 3, in the fixed shaft 5.

As the webs W travel past the roller assemblies 2*a* and 2*b*, these roller assemblies will emit the heated and the cooled air, respectively, from the outlet openings 33 in the rollers 3. Part of the air thus flowing out the openings 33 will be applied directly to the webs W, creating a plenum layer between webs and rollers and thereby holding the webs out of contact with the rollers.

The rest of the air, not applied directly to the webs W, will flow into the recovery chambers 40 defined by the baffles 41. The air will flow from the recovery chambers into the outlet openings 43, FIGS. 2 and 5, in the baffle side walls 44 and 45. With its flow rates through these openings 43 controlled by the flow control valves 9, the air will be introduced into the upstream and downstream side web-roller gaps $G_1$ and $G_2$. Such recovery and redirection of the air into the gaps $G_1$ and $G_2$ not only minimizes the waste of energy but serves the additional purposes of realizing ideal web flight over the rollers 3, as will become apparent as the description progresses.

Let it be assumed that there is no introduction of pressurized air into the web-roller gaps $G_1$ and $G_2$ of each roller assembly from the baffle side walls 44 and 45. Then, with web travel past each roller 3, turbulence would occur at the upstream side gap $G_1$ as air was drawn into the plenum space P between web and roller, resulting in a drop, as well as fluctuations, of the air pressure in this upstream side gap $G_1$. Turbulence would also occur at the downstream side gap $G_2$ as the air came in from the plenum space P, resulting in a rise, with accompanying fluctuations, of the air pressure in the downstream side gap $G_2$. Consequently, the web would tend to be drawn toward the roller 3 on its upstream side, reducing the gap $G_1$, and repelled away therefrom on its downstream side, augmenting the gap $G_2$, and at the same time would finely flutter while so traveling past the roller.

Experiment has proved that the redirection of the escaping air into the web-roller gaps $G_1$ and $G_2$ according to the invention serves to overcome such pressure variations and fluctuations there. The web is thus enabled to fly over the rollers 3 with a minimum of fluttering or wavering.

Such air redirection has also proved to accelerate the drying or cooling of the printings on the webs. The air streams entering the web-roller gaps $G_1$ and $G_2$ from the baffle side walls of each roller assembly create air curtains, so to say, which prevent turbulence from taking place in these gaps. Further the air streams stabilize the pressure of the plenum space P. For these reasons the hot or cold air will evenly heat or cool the web.

The webs being offset printed, as in the FIG. 1 printing press, are themselves moistened by damping water, beside bearing the printings that need compulsory drying. The heating roller assemblies 2*a* will thermally accelerate the evaporative desiccation of the web moisture and the ink solvent, and the infiltrative desiccation of the non-evaporating ink ingredients. Subsequently cooled by the cooling roller assemblies 2*b*, the printings will solidify and thoroughly dry and fix on the webs.

It is to be appreciated that the roller assemblies according to the invention accomplish their primary objectives, the drying and noncontact guiding of the webs, not just by the direct application of air from parts of the roller surfaces to the web but further by the recovery and redirection of the air escaping from the other parts of the roller surfaces, back into the web-roller gaps $G_1$ and $G_2$. It is a no less significant advantage, of course, that all the pressurized air that has been supplied to each roller assembly is utilized for the useful purposes. As practically no pressurized air is wasted, the roller assemblies according to the invention will consume much less pressurized air, and therefore much less energy, than comparative prior art devices.

Figure 5:
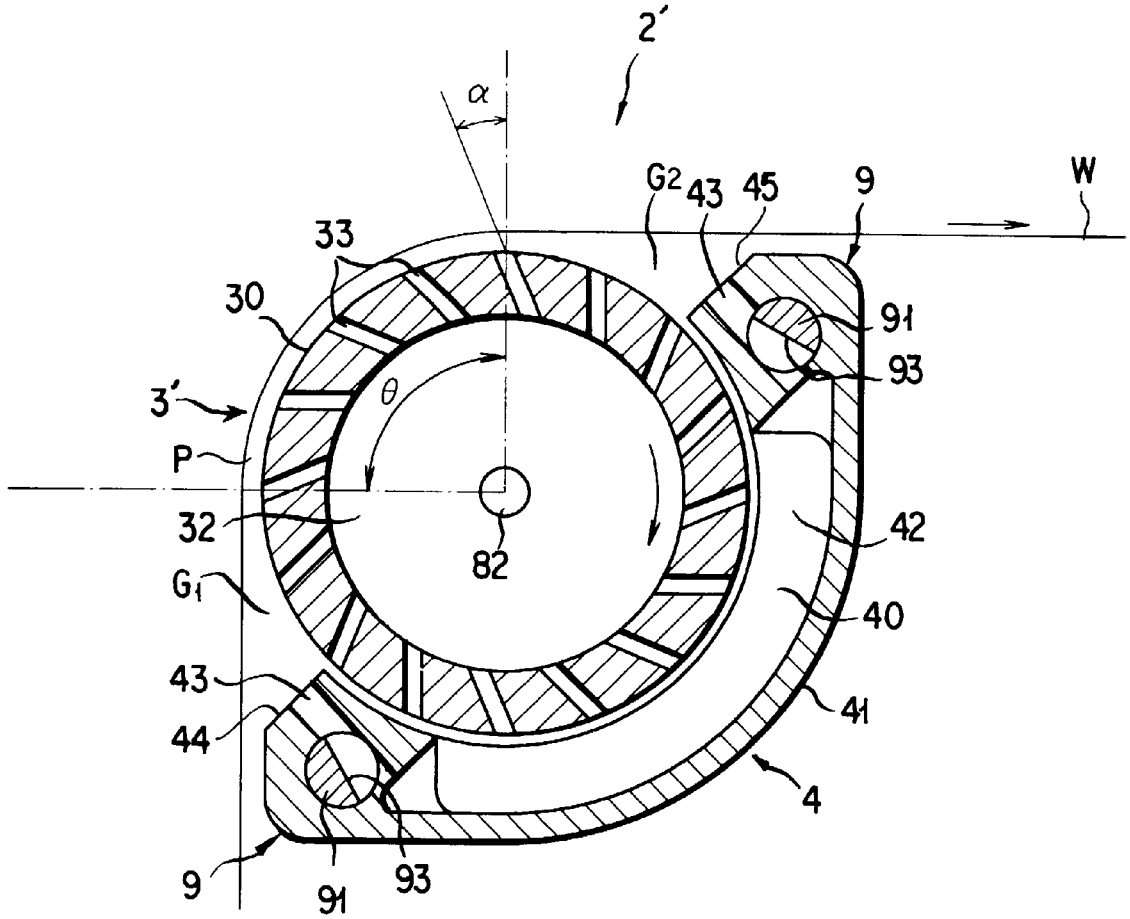
FIG. 5 is a view similar to FIG. 2 but showing another preferred form of roller assembly according to the invention.

The angular orientation of the air outlet openings 33 in the rollers 3, when these rollers are seen cross-sectionally as in FIGS. 2 and 5, also plays an important role in causing web flight thereover with the application of the least amounts of pressurized air. Generally, the less is the angle θ through which the web enwraps the roller, the greater will be the amounts of air that escapes from under the web, both in the upstream and downstream directions of the web, without effectively acting to lift and hold the web off the roller surface. Experiment has shown that the web most readily flies, and keeps flying, when pressurized air is applied thereto in a direction opposite to its traveling direction.

Thus, as has been set forth with reference to FIGS. 2 and 5, the air outlet openings 33 in the rollers 3 should extend approximately radially of the rollers or, preferably, be inclined upstream of the web as they extend radially outwardly of the rollers, at the angle α of up to approximately 60 degrees with respect to the radial direction of the rollers. The web will then be forced to travel against the airstreams being expelled from the nonradial openings 33 in the rollers 3. So traveling, the web will offer resistance to the airstreams by virtue of its microscopic surface irregularities due to the paper fibers and so cause the airstreams to stay the longer period of time between the web and the roller. Furthermore, with the openings 33 so angled, the greater the angle α, the more easily will the airstreams issuing therefrom create a stable plenum layer between the web and the roller.

With the printed webs W flying over the roller surfaces without fluttering as above, there is practically no risk of the webs staining the rollers, or of the webs being stained in return by the stained rollers. The results are the reduction of waste of paper, the improvement of the quality of the printings, and the curtailment of maintenance labor and costs.

Figure 6:
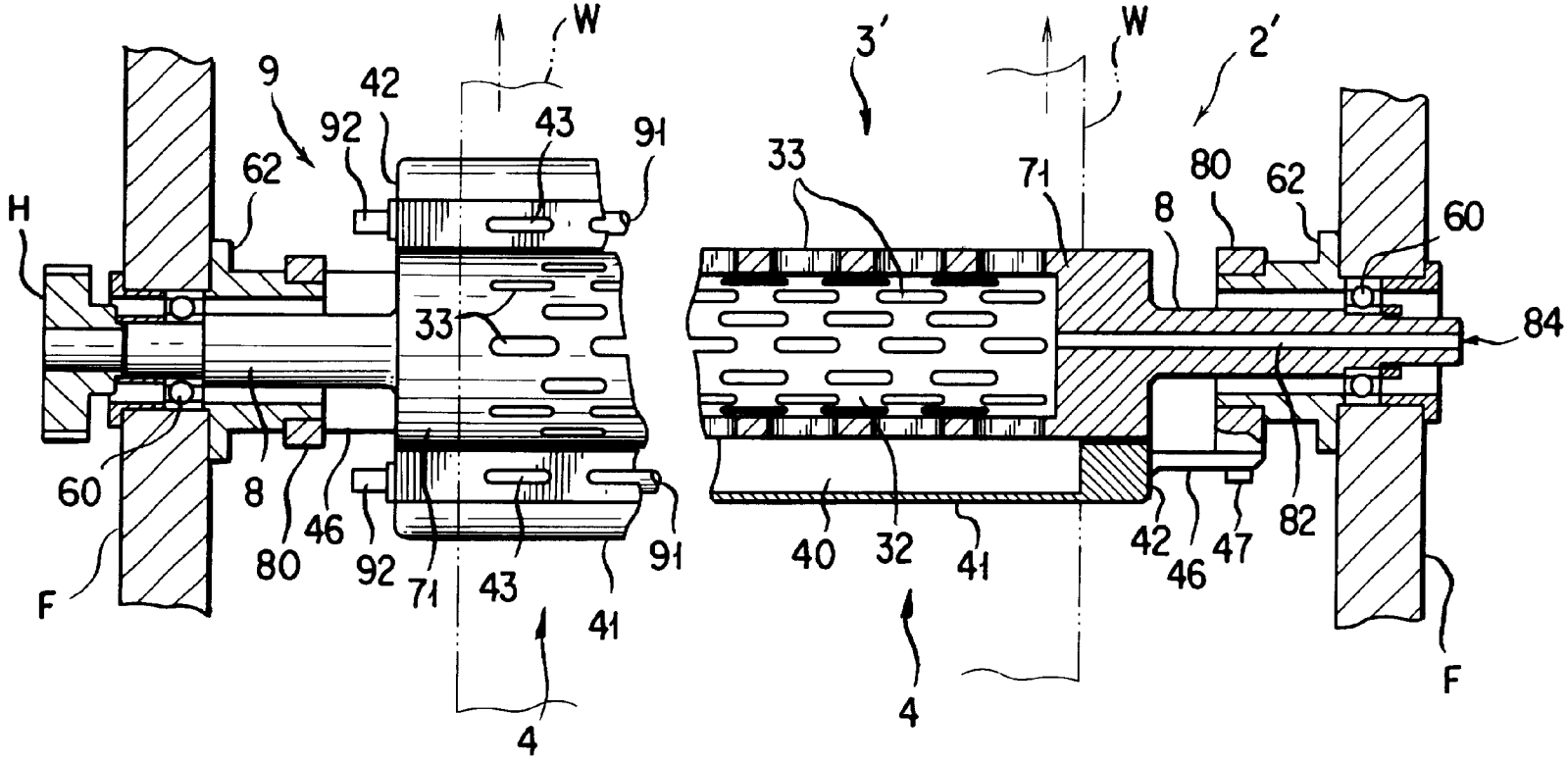
FIG. 6 is a view similar to FIG. 3 but showing the FIG. 5 roller assembly.
Figure 7:
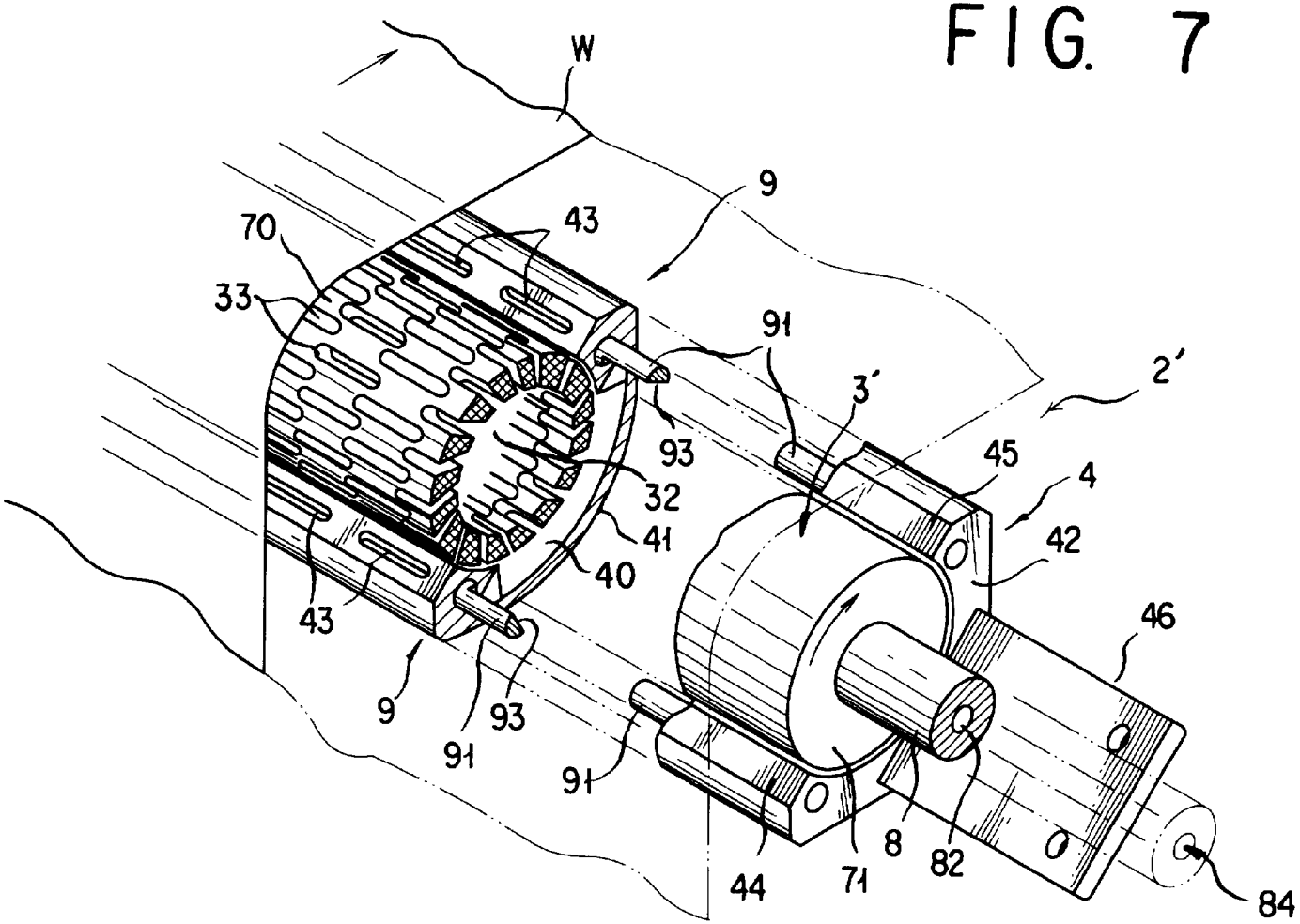
FIG. 7 is a fragmentary perspective view, partly broken away and partly shown in section for clarity, of the FIG. 5 roller assembly.

FIGS. 5–7 show an alternative form of noncontact roller assembly 2' for use in the FIG. 1 printing press in place of any of the heating and cooling roller assemblies 2*a* and 2*b* used there. The alternative roller assembly 2' is also a combination of a roller 3' and baffle means 4. However, unlike its FIGS. 1–4 counterpart 3 which is self-propelled pneumatically, the roller 3' of this second embodiment is made capable of gear drive for forced rotation in the same direction as the web W flying thereover.

As will be best understood from FIG. 6 taken together with FIG. 7, the roller 3' is similar to the FIGS. 1–4 roller 3 in being in the form of a hollow, perforated cylinder defining the plenum chamber 32. Both ends 71 of the roller 3' are closed. A pair of shafts 8 coaxially extend from these closed ends 71 of the roller 3' and are journaled in bearings 60 thereby to be rotatably mounted to the pair of framing walls F. One of the shafts 8 further extends past the wall F and has a driven gear H mounted fast thereon. Thus the roller 3' can be gear driven, as required, from the torque source, not shown, that is usually incorporated in the FIG. 1 machine for driving the various moving parts thereof.

Extending through the other shaft 8 is an air passageway 82 which is open on one hand to the plenum chamber 32 within the roller 3'. On the other hand the passageway 82 leads to a port 84 to which is to be coupled a conduit, not shown, via a rotary joint, also not shown, for communicating the plenum chamber 32 with the unshown source of air under pressure.

The roller 3' has formed in its surf ace the multiplicity of openings 33 for emitting the air supplied as above to its plenum chamber 32. A comparison of FIGS. 5 and 6 with FIGS. 2 and 3 will show that the openings 33 are akin to those of the FIGS. 1–4 embodiment in number, size, shape, arrangement, and angular orientation with respect to the radial direction of the roller.

The baffle means 4 together with the flow control valves 9 is of the same construction as in FIGS. 2–4 except for the way the baffle means is mounted to the framing walls F. As clearly shown in FIG. 6, the pair of mounting lugs 46 extending from the end walls 42 of the baffle 41 are respectively fixed by screwes 47 to a pair of mounting rings 80. These mounting rings are themselves fitted over sleeves 62 which surround the rotatable shafts 8 with substantial clearances and which are affixed endwise to the framing walls F. It is understood that the mounting rings 80 clamped themselves around the fixed sleeves 62 so as to permit an adjustable change in the angular position of the baffle means 4 about the axis of the roller 3', just as the FIGS. 1–4 baffle means is angularly adjustable around the roller 3.

The operation of the FIGS. 5–7 embodiment is considered self-evident from the foregoing operational description of the FIGS. 1–4 embodiment, the only difference between the two embodiments being whether the rollers are mechanically driven or not. Thus the second embodiment gains the same advantages as does the first.

Figure 8:
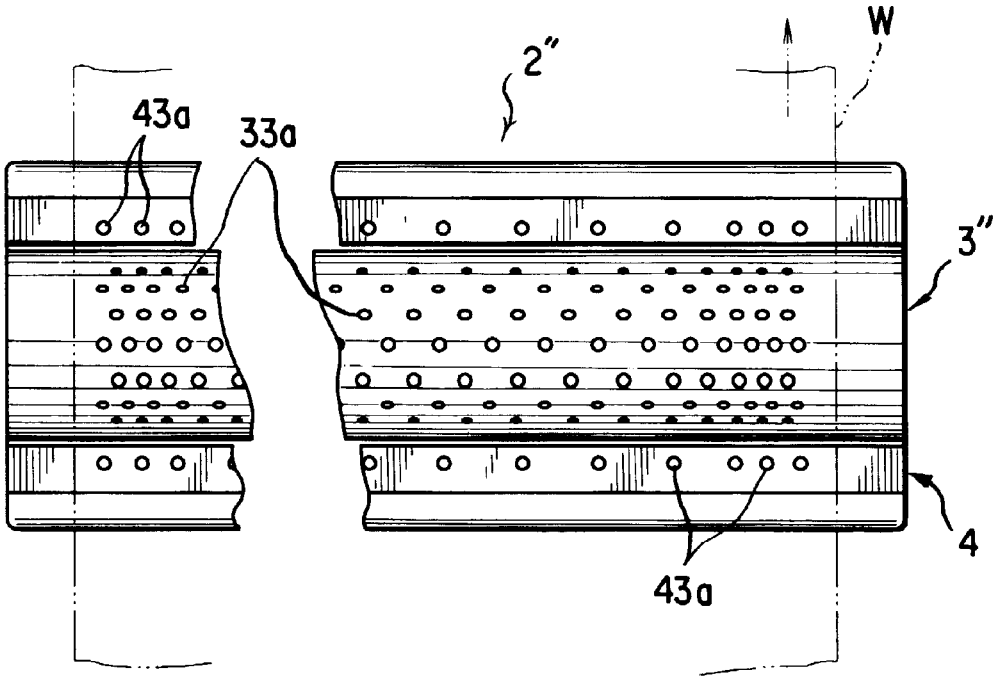
FIG. 8 is an elevational view, partly broken away for illustrative convenience, of still another preferred form of roller assembly according to the invention.

In FIG. 8 is shown another modified noncontact roller assembly 2", also for use in the FIG. 1 printing press in place of any of the heating and cooling roller assemblies 2*a* and 2*b*. The modified roller assembly 2" features relatively small air outlet openings 33*a* of circular cross sectional shape formed in the roller 3", and air outlet openings 43*a* of similar shape and size formed in the side walls of the baffle means 4.

The openings 33*a* in the roller 3" are similar to the FIG. 2 openings 33 in the roller 3 in being aligned longitudinally of the roller and in the staggered arrangement of the longitudinal rows. Further, in this FIG. 8 embodiment, the openings 33*a* are more densely distributed in portions adjacent to the opposite ends of the roller 3 than in its midportion, so that greater amounts of air will be applied to the web in the neighborhoods of its opposite lateral edges than in its midpart. This distribution is recommended in cases where there is too much air escaping from the opposite sides of the web.

The advantages gained by the instant invention may be recapitulated as follows:

1. The roller assembly is so simplified and compact in construction that it is manufacturable far more inexpensively than heretofore.

2. No inking of the roller and hence of the web is to occur, resulting in the curtailment of waste of paper and the improvement of printing quality.
3. The roller assembly needs no modification at all for use either for combined guiding and heating, or for combined guiding and cooling, of the web as in a newspaper printing machine.
4. The air supplied under pressure to the roller assembly or assemblies is utilized most wastelessly for web levitation and/or desiccation, with the consequent reduction of the expenses for these purposes.
5. The air gap between web and roller is stable and free from flutter and undulations.
6. The air outlet openings in the roller and in the baffle side walls are not so fine as to necessitate air filtration.

Various modifications and alterations of the illustrated embodiments will suggest themselves to one skilled in the art without departing from the scope of the invention as expressed in the claims which follow.

What is claimed is:

1. A noncontact guide roller assembly suitable for use in web-fed rotary printing press for guiding a web of paper, the roller assembly comprising (a) a roller in the form of a hollow cylinder defining a plenum chamber therein, the roller having formed in its surface a multiplicity of air outlet openings in communication with the plenum chamber, so that air supposed under pressure to the plenum chamber is expelled from the air outlet openings in order to keep out of contact with the roller a web traveling over circumferential part of the surface roller; and (b) baffle means enclosing at least part of the other circumferential part of the roller surface for confining the air being expelled from the openings in said at least part of said other circumferential part of the roller surface and for redirecting the confined air into a pair of spaces, spaced circumferentially of the roller, between the web and the roller.

2. The noncontact guide roller assembly of claim 1 wherein the baffle means comprises:

(a) a baffle defining an air recovery chamber for confining the air being expelled from the openings in said at least part of said other circumferential part of the roller surface, the baffle having a pair of side edges spaced from each other circumferentially of the roller; and (b) a pair of side walls formed along the side edges of the baffle and each having formed therein a plurality of air outlet openings for communicating the air recovery chamber with one of the pair of spaces between the web and the roller.

3. The noncontact guide roller assembly of claim 2 further comprising valve means for adjustably varying the flow rates of air through the air outlet openings in the side walls of the baffle.

4. The noncontact guide roller assembly of claim 3 wherein the air outlet openings in each side flange of the baffle are aligned longitudinally thereof, and wherein the valve means comprises:

(a) a pair of stems rotatably extending one through each side flange of the baffle, each stem having a series of recesses formed therein in register with the air outlet openings; and (b) means for rotating each stem relative to the side flange of the baffle.

5. The noncontact guide roller assembly of claim 1 wherein the air outlet openings in the roller are inclined upstream, with respect to a prescribed traveling direction of the web being guided, as they extend radially outwardly of the roller.

6. The noncontact guide roller assembly of claim 5 wherein the angle of inclination of the air outlet openings in the roller relative to the radial direction of the roller is up to approximately 60 degrees.

7. The noncontact guide roller assembly of claim 1 wherein the air outlet openings in the roller are more densely distributed in portions adjacent to the opposite axial ends of the roller than at its midportion.

8. A web-fed rotary printing press comprising:

(A) web supply means for continuously supplying a web to be printed upon;

(B) printing means for printing on the web being supplied from the web supply means;

(C) postprinting processing means for processing the web that has been printed upon by the printing means; and (D) a noncontact guide roller assembly positioned between the printing means and the postprinting processing means for guiding the printed web from the former toward the latter, the roller assembly comprising:

(a) a roller in the form of a hollow cylinder defining a plenum chamber therein, the roller having formed in its surface a multiplicity of air outlet openings in communication with the plenum chamber, so that air supplied under pressure to the plenum chamber is expelled from the air outlet openings in order to keep out of contact with the roller the web traveling over circumferential part of the surface of the roller; and (b) baffle means enclosing at least part of the other circumferential part of the roller surface for confining the air being expelled from the openings in said at least part of said other circumferential part of the roller surface and for redirecting the confined air into a pair of spaces, spaced circumferentially of the roller, between the web and the roller.

9. The rotary printing press of claim 8 wherein the guide roller assembly further comprises a shaft nonrotatably mounted to frame means and having an air passageway extending therethrough, the roller being rotatably and pressure-tightly mounted on the shaft and having the plenum chamber in constant communication with the air passageway in the shaft.

10. The rotary printing press of claim 9 further comprising means for mounting the baffle means to the shaft so as to permit an adjustable change in the angular position of the baffle means relative to the roller.

11. The rotary printing press of claim 8 wherein the guide roller assembly further comprises a pair of shaft coaxially extending from opposite ends of the roller and rotatably supported by frame means, one of the shafts having an air passageway extending therethrough in constant communication with the plenum chamber within the roller.

12. The rotary printing press of claim 11 further comprising means f or mounting the baffle means to the frame means so as to permit an adjustable change in the angular position of the baffle means relative to the roller.

13. The rotary printing press of claim 11 further comprising a driven gear nonrotatably mounted on the other of the shafts.

14. A web-fed rotary printing press comprising:

(A) web supply means for continuously supplying a web to be printed upon;

(B) printing means for printing on the web being supplied from the web supply means;

(C) postprinting processing means for processing the web that has been printed upon by the printing means;

(D) a noncontact heating roller assembly positioned between the printing means and the postprinting processing means, the heating roller assembly comprising:

(a) a roller in the form of a hollow cylinder defining therein a plenum chamber to which relatively hot air is to be supplied under pressure, the roller having formed in its surface a multiplicity of air outlet openings in communication with the plenum chamber, so that the hot air supplied to the plenum chamber is expelled from the air outlet openings in order to keep out of contact with the roller the web traveling over circumferential part of the surface of the roller; and (b) baffle means enclosing at least part of the other circumferential part of the roller surface for confining the air being expelled from the openings in said at least part of said other circumferential part of the roller surface and for redirecting the confined air into a pair of spaces, spaced circumferentially of the roller, between the web and the roller; and (E) a noncontact cooling roller assembly positioned between the heating roller assembly and the postprinting processing means, the cooling roller assembly being of the same construction as the heating roller assembly except that relatively cold air is applied from the roller to the web;

(F) whereby the web with printings thereon is dried by the heating and the cooling roller assembly while traveling noncontact from the printing means to the postprinting pressing means.

* * * * *